US009087415B1

(12) United States Patent
McLain et al.

(10) Patent No.: US 9,087,415 B1
(45) Date of Patent: Jul. 21, 2015

(54) SYSTEM AND METHOD FOR CONTROL OF A PARKING FACILITY

(76) Inventors: Kevin W. McLain, Costa Mesa, CA (US); Eric Cardin, Costa Mesa, CA (US)

( * ) Notice: Subject to any disclaimer, the term of this patent is extended or adjusted under 35 U.S.C. 154(b) by 287 days.

(21) Appl. No.: 13/507,668

(22) Filed: Jul. 18, 2012

(51) Int. Cl.
*G08G 1/123* (2006.01)
*G07B 1/00* (2006.01)

(52) U.S. Cl.
CPC ..... *G07B 1/00* (2013.01)

(58) Field of Classification Search
CPC ..... G07B 1/00; G08G 1/207; G08G 1/145; G06T 220/30264; G07F 17/24; G07C 1/30
USPC ..... 340/932.2, 933, 937, 425.5; 348/148, 348/159
See application file for complete search history.

(56) References Cited

U.S. PATENT DOCUMENTS

| | | | | |
|---|---|---|---|---|
| 5,343,237 | A * | 8/1994 | Morimoto | 348/143 |
| 5,777,951 | A * | 7/1998 | Mitschele et al. | 368/90 |
| 6,081,206 | A * | 6/2000 | Kielland | 340/937 |
| 6,459,386 | B1 * | 10/2002 | Jones | 340/932.2 |
| RE38,626 | E * | 10/2004 | Kielland | 340/937 |
| 7,104,447 | B1 * | 9/2006 | Lopez et al. | 235/384 |
| 7,679,526 | B2 * | 3/2010 | Mardirossian | 340/932.2 |
| 2008/0308631 | A1 * | 12/2008 | Mitschele et al. | 235/384 |
| 2011/0140927 | A1 * | 6/2011 | Lee | 340/993 |

* cited by examiner

*Primary Examiner* — Phung Nguyen
(74) *Attorney, Agent, or Firm* — Dennis W. Beech

(57) ABSTRACT

For parking facility management, a portable unit may have a data element for receiving data for parked vehicles that is displayed to a local user, may be printed, or may be transmitted to a remote parking management server. The unit also has a selection criteria element to identify illegally parked vehicles from the data received. A camera may be used to record parked vehicles, violations and location. A calculating element in the unit may be used to identify a parked vehicle as a repeat offender to determine whether a courtesy notice, a citation form, or a tow authorization from is to be prepared and transmitted to the appropriate agencies, companies and vehicle owner to effect a towing and impounding of a parked vehicle.

3 Claims, 6 Drawing Sheets

PARKING VIOLATION

COMPANY MANAGEMENT AGENCY (714) 456-PARK

Day _____ Date _____ Time _____ am/pm
VIN # _____ Color _____ Doors
Year _____ Make _____ Model _____
License #_____ State ___ Expiration Month _____ Year___

THIS VEHICLE IS ILLEGALLY PARKED IN VIOLATION OF THE RULES AND REGULATIONS OF THIS PROPERTY. VEHICLE MUST BE MADE COMPLIANT WITHIN _____ HOURS OR IT WILL BE TOWED AWAY AT THE VEHICLE OWNERS EXPENSE.

☐ NO VALID VISIBLE PERMIT DISPLAYED
(PERMITS ON TINTED WINDOWS ARE NOT VISIBLE PERMITS)

☐ NOT REGISTERED WITH COMPANY

☐ EXPIRED CONFIRMATION NUMBER

☐ INVALID PERMIT

☐ PARKED IN NO PARKING ZONE

☐ HANDICAPPED PARKING ONLY

☐ PARKED OVER 72 HOURS (STORED)

☐ PARKED IN AN UNASSIGNED CARPORT

☐ OTHER _____

SIGNATURE_____

FIG. 4

THE TOW RELEASE FORM MAY INCLUDE THE FOLLOWING

A copy of the Original written authorization for the removal of the vehicle and all of the following:
The make, model, vehicle identification number, and license plate number of the removed vehicle.
The name, signature, job title, residential or business address and working telephone number of the person authorizing the removal of the vehicle.
The grounds for the removal of the vehicle.
The time when the vehicle was first observed parked at the private property.
The time that authorization to tow the vehicle was given.

If the vehicle was towed from a residential property, the tow company will have the ability to redact the name, signature, job title, residential or business address and working telephone number of the person who authorized the removal prior to releasing the form to the vehicle owner or their agent.

The release form shall also include a separate notice that provides the telephone number of the appropriate local law enforcement or prosecuting agency by stating "If you believe that you have been wrongfully towed, please contact the local law enforcement or prosecuting agency at [insert appropriate telephone number]." The notice shall be in English and in the most populous language, other than English, that is spoken in the jurisdiction.

ALSO INCLUDED WILL BE THE BREAKDOWN OF TOW CHARGES, PRIOR DAMAGES, LABOR, TAXES, FEES AND ANY ADDITIONAL INFORMATION WHICH MAY BE REQUIRED BY LAW

FIG. 5

ID ACTIVATION CONFIRMATION # _____

(COMMUNITY NAME) PROPERTY PARKING RULES

Resident(s) Name(s): TEST X, TEST1 TEST1

Apartment Number: X Carport Number: X Garage Number: X

Resident ID# Number Assigned: cbddc

ALL VEHICLES MUST BE REGISTERED WITH Company PRIOR TO ENTERING ANY GATED OR RESIDENT ONLY PARKING AREA. ONLY VEHICLES WHICH DISPLAY A VALID "VIRTUAL PERMIT" OR Company TEMPORARY CONFIRMATION NUMBER ARE CONSIDERED REGISTERED.

ALL VEHICLES TEMPORARILY IN RESIDENT ONLY AREAS OF THE PROPERTY MUST DISPLAY A VALID Company CONFIRMATION NUMBER IN THE LOWER LEFT-HAND CORNER (DRIVER'S SIDE) OF THE FRONT WINDSHIELD AT ALL TIMES. UNREGISTERED VEHICLES WILL BE TOWED AT THE VEHICLE OWNERS EXPENSE.

A valid Virtual Permit (Registered License Plate or VIN Number) must be displayed on all permanently registered vehicles Transfer of a Temporary Confirmation number for any reason to another vehicle is NOT AUTHORIZED. Transferring a confirmation number for any reason will result in the invalidation of the parking authorization.

Each apartment may have TWO (2) vehicles registered which can be parked in one assigned carport and any available open unassigned space. Please DO NOT PARK BOTH of your vehicles in open spaces as this takes away a neighbors open parking spot.

NO GUEST PARKING is allowed and/or permitted with the following exception: Residents with two registered vehicles may temporarily suspend one vehicle while allowing guests/visitors to park in their assigned space(s.) You must call Company and provide the resident space number the guest will be parked in and their vehicle information. You will be issued a Temporary Confirmation number which must be displayed in your guests vehicle at all times while parked on the property.

WARNING: SUSPENDED (THIRD) VEHICLES PARKED IN RESIDENT PARKING AREAS IS NOT ALLOWED AND ARE SUBJECT TO IMMEDIATE REMOVAL/TOW AT THE VEHICLE OWNERS EXPENSE.

Please do not park your vehicles or have your guest park in the spaces reserved outside the leasing office for "PROSPECTIVE RESIDENT PARKING ONLY" during the times posted on the signs.

Residents are required to inform their Guest/Visitors of the community parking rules and regulations. Residents are also required to notify their guests/visitors of the potential violations received as a result of not complying with community parking rules and regulations. Unauthorized Vehicles will be removed at the vehicle owner's expense.

Registered Resident vehicles are NOT ALLOWED to park in designated GUEST PARKING areas.

Read and obey ALL POSTED SIGNS, painted curbs and painted roadways on the premises. No Parking is allowed in any designated fire lane or roadways.

Parking spaces and stalls shall be used only for the parking of passenger automobiles or light utility vehicles used for personal transportation. Parking of other industrial and/or commercial trucks, trailers and recreational vehicles (including Boats) without Company's authorization is not permitted at any time.

Stored Vehicles: vehicles may not be parked for longer than 96 hours (stored). Any vehicle parked in open or assigned parking (INCLUDING CARPORTS) over 96 hours, without authorization from Company is considered STORED and subject to immediate tow.

FIG. 6

SYSTEM AND METHOD FOR CONTROL OF A PARKING FACILITY

BACKGROUND OF THE INVENTION

This invention relates to an automated method and system for controlling parking and for controlling non-consensual towing, also referred to as private property impound or PPI, in private property parking facilities and, more particularly, to a method and system for authorizing the removal and managing the towing process of illegally parked vehicles from commercial and residential private property.

Currently the control of private parking facilities such as parking structures, parking lots and non-public street parking to manage allowed parking and illegal parking may be accomplished in a number of ways depending on the laws of a region or state. In some jurisdictions an owner or their agent monitor parked vehicles and parking permits by human patrol of the parking facility to check vehicles. If a vehicle is not legally parked, the agent may exercise a number of options. These may include the issuing of a courtesy notice card or form by hand for placement on the vehicle.

In instances or jurisdictions in which a formal notice is necessary, a citation form warning the vehicle owner that the vehicle may be towed based on violation of the rules of the parking facility and applicable local laws may be prepared by the agent using for example a two sheet copy form with one copy placed on the vehicle and one copy transported to the property management. If a vehicle is in violation or remains parked illegally a non-consensual tow or private property impound (PPI) authorization form may be prepared by the agent to include the vehicle identity data; the date, time and place of the parking violation; and the reasons for the parking violation. The agent may then contact a towing company to tow the vehicle to an impound location; and where required by local law, notify the public agency, for example, the police of the towing of the vehicle.

The towing company operator may be required to prepare a towing service form with information similar to the PPI form and a release authorization as well information regarding the towing and impound location for a vehicle owner's pickup. The towing company may also have to notify a local public agency, for example, the police of the towing action. The documentation is often done using paper, multi-copy forms with authorization signatures and the notice or contact is often done by telephone.

Towing company operators or truck drivers risk their lives every day to assist stranded motorists and keep the roadways clear of disabled vehicles. Until recently, however, a lack of Federal and State laws allowed the ranks of the profession to be infiltrated by unscrupulous drivers who practice predatory towing. The worst cases of predatory towing involve "patrol" or "satellite" towing. That's when a tow truck driver, on a tip from a spotter, tows away a car illegally parked on private property, such as a no-parking area of a shopping mall or apartment complex. If that happens, the car owner has to pay the cost of towing, storage, and other fees to get the car back.

In the United States, several states have recently enacted or are in the process of creating laws that regulate the circumstances under which a car may be towed. These laws are designed to prevent "predatory towing" whereby a legally parked vehicle is towed—or an illegally parked vehicle is towed by a towing operator unaffiliated with the parking facility.

An example of new laws is one in California to protect vehicle owners against the worst of illegal towing. Under CVC22658, a towing company cannot commence the removal of a vehicle from private property without first obtaining written authorization from the property owner, authorized agent, lessee or an employee who must be physically present at the time of removal and verify the alleged violation. In addition California law requires the tow company to immediately and unconditionally release a vehicle if the driver arrives prior to it being towed from the private property and in transit. The intent is to avoid the likelihood of dangerous and violent confrontation and physical injury to vehicle owners and towing operators, the stranding of vehicle owners and their passengers at a dangerous time and location, and impeding expedited vehicle recovery, without wasting law enforcement's limited resources.

A tow truck operator who violates this law is subject to a civil misdemeanor, a fine of $2,500, and/or three months in jail. Also, vehicle owners who can prove they have been charged illegal or excessive towing or storage fees are entitled to recover four times the amount of those fees in small claims court.

SUMMARY OF THE INVENTION

The present invention is directed to systems and methods for control of commercial and residential private parking and portable units for use in parking facility management. A unit may have a data element for receiving data for parked vehicles that is displayed to a local user, may be printed, or may be transmitted to and from a remote parking management server. The unit also has a selection criteria element to identify illegally parked vehicles from the data received. A camera may be used to record parked vehicles and location. Date, time and GPS tracking information may also be collected. A calculating element in the unit may be used to identify a parked vehicle as a repeat offender to determine whether a courtesy notice, a citation form, or a private property impound form is to be prepared and transmitted to the appropriate agencies, companies and vehicle owner to effect a towing and impounding of a parked vehicle.

These and other features, aspects and advantages of the present invention will become better understood with reference to the following drawings, description and claims.

BRIEF DESCRIPTION OF THE DRAWINGS

FIG. 4 illustrates the contents of a parking violation form according to an embodiment of the invention;

FIG. 5 illustrates the contents of a towing and impound addendum form according to an embodiment of the invention;

FIG. 6 illustrates the contents for property parking rules form according to an embodiment of the invention.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
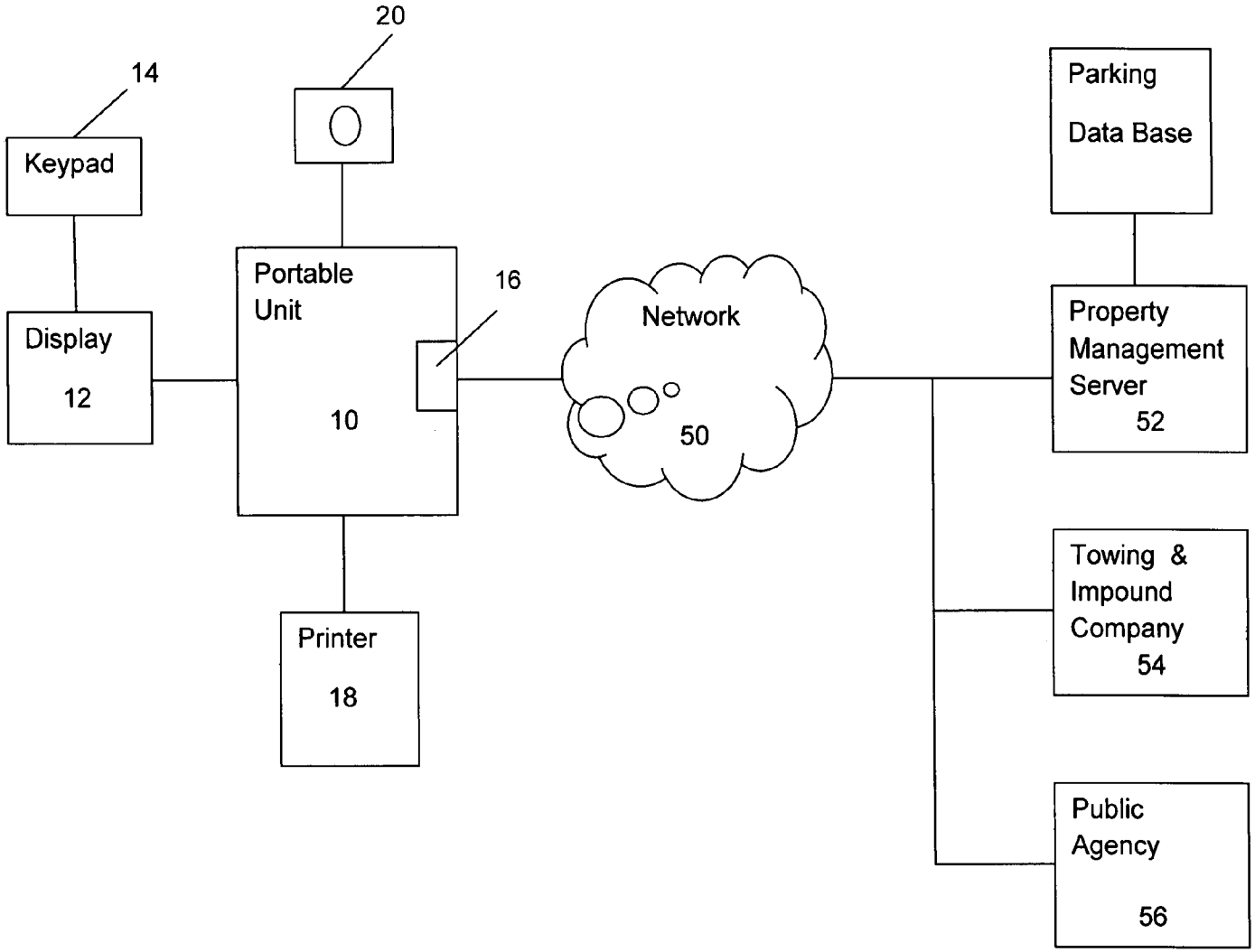
FIG. 1 illustrates a block diagram of parking facility illegal parking control according to an embodiment of the invention.

Referring to FIG. 1, a system and method for managing a parking facility has a unit 10 that may be portable for use in parking facility management. The unit 10 has a visual display 12 and a keypad 14 that may be a touch panel incorporated into the display 12. The unit 10 has a transmitter-receiver interface 16 for hardwire and wireless, such as, electromagnetic or light spectrum, communication through a network 50 to a property management server 52, a towing and impound company 54, and a public agency 56. The network 50 may be the World Wide Web, a cellular telephone service, or other suitable network. The unit 10 also has a printer interface for a printer 18 that may be incorporated in the unit 10. A photographic camera 20 that may be a digital camera and may be incorporated in the unit 10 is also an element.

Figure 2:
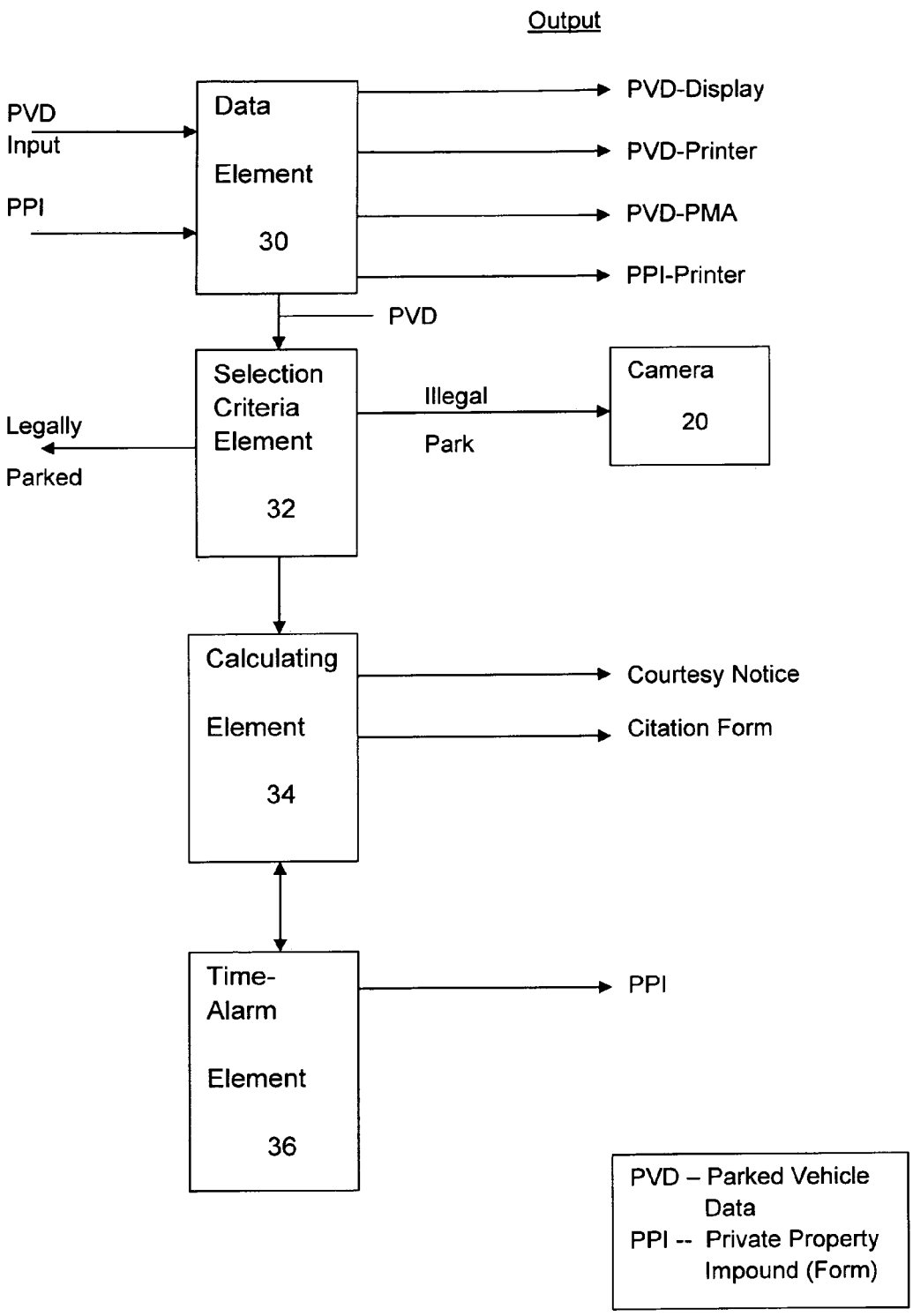
FIG. 2 illustrates a block diagram of an illegal parking unit for parking control according to an embodiment of the invention.

Referring to FIGS. 1 and 2, a data element 30 is incorporated in the unit 10 for receiving input of data for a parked vehicle for display to a local user, and for printing and transmitting of the parked vehicle data for use by a policing agent and a property management agent. A selection criteria element 32 is incorporated in the unit 10 for evaluation of parked vehicle data to determine legal and illegal parking status and signaling when an illegally parked vehicle is detected for operation of the camera 20 and recording of the parked vehicle and surrounding location. The parking status checking may include use of permits issued in the form of tags, window or bumper stickers and the like that may have an identity code imprinted such as a bar code or quick response QR code.

A vehicle management system may be designed to integrate into the leasing process at move-in and upon renewal for private property controlled facilities. Vehicle information i.e. make, model, license and VIN are entered into the database as well as driver information name, address and contact information. The system then generates an alpha numeric ID number which is linked to a QR or (quick response) parking permit and prints a property parking agreement including the property parking rules and instructions regarding making changes to a record to be executed by the tenant. Upon execution of the agreement the tenant receives a resident ID card as well as their parking sticker. Any future changes to a record may only be made by a registered ID holder. While a tenant-landlord data base system has been described, other facilities may be similarly managed, for example, schools, universities, hospitals, or other large venues.

A mobile element may be designed to comply with the most stringent state laws governing non-consensual towing in the United States. By eliminating the tow operator from the authorizing process and providing the technology to record, interact, enter information with the bar code or QR reader and disperse information and data to pre designated locations in multiple media forms. When a vehicle is found in violation and it is determined that a tow is required, vehicle information is collected and documented then dispersed to designated recipients based on the guidelines set by the local legal jurisdiction. The information is then routed to a secure server and a tow authorization form is generated and printed in the field. Corresponding information is collected and entered into a restricted file which generates a tow release form in compliance with state law to be issued by the tow operator to the vehicle owner and any designated recipients upon retrieval of the vehicle.

A calculating element 34 compares the parked vehicle data to the past stored vehicle data for illegal parking and the type of parking offense, for example, red zone parking, no permit, and the like, to evaluate repeat offenders. If there are prior offenses and they are less than a specified number (x), a courtesy notice is printed, see FIG. 4 parking violation form. The courtesy notice may be placed on the vehicle by an authorized agent.

If there are prior offenses and they are more than the specified number (x), a citation form is created and transmitted to the property management server 52. A signature may be placed on the citation form and the citation form may be printed with additional notice information and signature, see FIG. 4 with signature portion of form. The citation form is usually placed on the vehicle to give notice of towing if the vehicle is not moved within a specified number of hours. A time-alarm element 36 is set to alert for a recheck of the illegally parked vehicle.

When a vehicle is checked after the specified time entered for the citation form, if the calculating element 34 determines an overtime condition for the parked vehicle, a private property impound form is created and transmitted to the property management server 52. A property management agent signs and retransmits the private property impound form to the data element 30, to a towing and impound company agent 54 and to a public agency 56. A private property impound form is printed for use in arranging towing and impounding of the illegally parked vehicle, see FIG. 5 for additional information to provide on a form similar to FIG. 4 as private property impound form.

Figure 3:
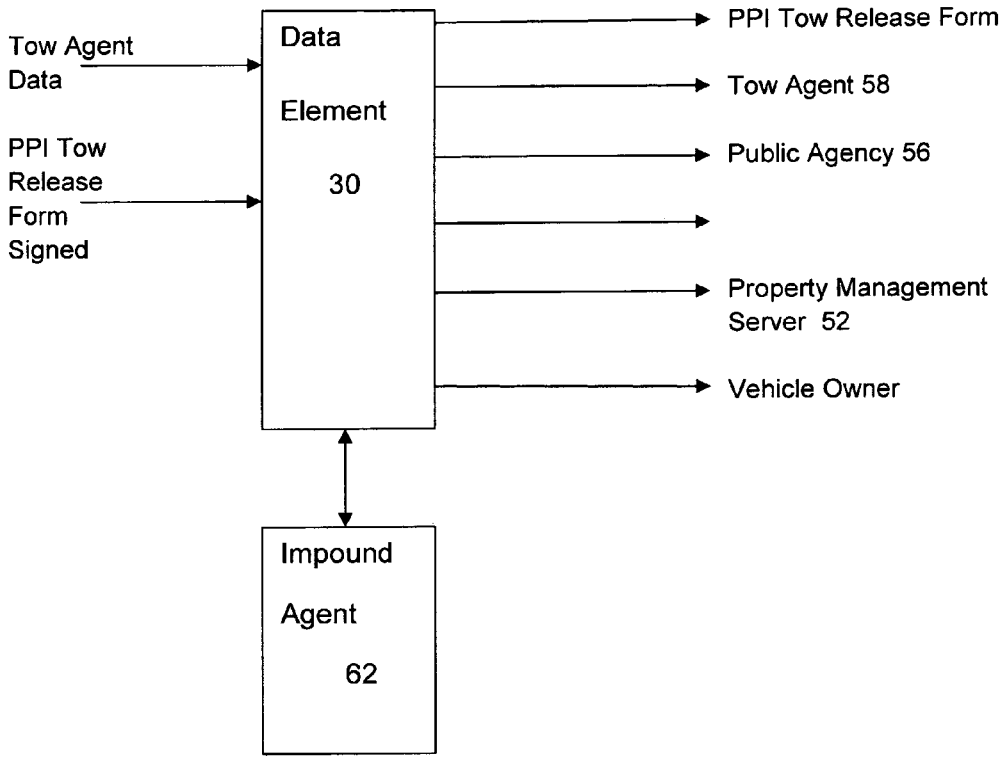
FIG. 3 illustrates a flow diagram of an illegal parking routine to generate a private property impound action according to an embodiment of the invention.

Referring to FIG. 3, the system and method may also include further management of the towing and impound actions. The unit 10 data element 30 receives input data of a tow agent data file from the towing company 54 and the camera 20 is activated to record the parked vehicle and surrounding location when a tow agent arrives. A private property impound tow release form is created and transmitted to the property management server 52 and to a tow agent 50. A property management agent and a tow agent sign the private property impound tow release form and the form is retransmitted to the data element 30, to the tow agent 58, and to a public agency 56. When the vehicle is at the impound site an impound agent 62 transmits impound site data to the data element 30, the property management agent, the tow agent, the public agency and the vehicle owner. In those cases where the towing company 54 does not transmit information through the data element 30, the towing company 54 would also be required to notify the property management agent, the public agency and the vehicle owner.

The data presented in the form of the courtesy notice, citation form, private property impound form, and the private property impound tow release form may vary depending on the laws and rules of a particular government jurisdiction. The Figures represent examples of possible content. Also the rules for private property parking facilities including posting or notice of such rules may vary by venue or jurisdiction, see FIG. 6 for an example of private parking rules. The transmission of data and information may use telephone, facsimile, email, text, remote printer or other methods. The signing and transmission regarding documents or forms may use wet signatures where valid for the jurisdiction.

The unit 10 may be generally an integral unit such as a current multi-feature cellular telephone, a personal assistant, a hands free head mount smart phone system, a tablet computer, a laptop computer and the like, or a less integrated unit such as a hand held device with a display in communication with elements such as a portable printer and a digital camera linked by close, short transmit or other communication. The Global Positioning System or GPS technology may be included for position and time data.

While the invention has been particularly shown and described with respect to the illustrated embodiments thereof, it will be understood by those skilled in the art that the foregoing and other changes in form and details may be made therein without departing from the spirit and scope of the invention.

We claim:

1. A device that is portable for use in parking facility management comprising:

a data input element for receiving data for a parked vehicle, for display to a local user, for printing and for transmitting said data to a remote parking management server;

a selection criteria element for a legally parked and an illegally parked vehicle and when an illegally parked vehicle is detected:

photographs are recorded by a camera of the parked vehicle and location;

a calculating element determines a count of the number of times an identified parked vehicle has been illegally parked and the type of offense to then compare the number of times to repeat offender criteria, and when less than number (x) of offenses and less than number (y) of courtesy notices, then print a courtesy notice, when more than number (x) of offenses and more than number (y) of courtesy notices, then print a citation form and transmit the citation form to said property management server;

a time-alarm element is set to alert to recheck the parked vehicle;

a recheck time is entered and said calculating element determines an overtime condition for the parked vehicle, then prepares and transmits a private property impound authorization form to said property management server;

an authorized agent signs and retransmits the private property impound authorization form to said data input element, to a towing agent, to an impound agent and to a public agency; and prints a private property impound authorization form for said parked vehicle.

2. The device as in claim 1 wherein:

said data element receives a tow agent data file and activates said camera for photographs on action of a tow agent;

a private property impound tow release form is created, transmitted and signed by the authorized agent and the tow agent;

a signed private property impound tow release form is transmitted to the property management agent, the tow agent and a public agency;

an impound agent transmits impound site data to said data element, the property management agent, tow agent, a public entity, and the vehicle owner.

3. The device as in claim 1 wherein the parked vehicle has an identity tag with an identity code imprint.

* * * * *